United States Patent [19]

Kondo et al.

[11] 4,382,240

[45] May 3, 1983

[54] CIRCUIT BREAKER

[75] Inventors: Hideya Kondo; Youichi Yokoyama; Youichi Aoyama; Tamotsu Mori, all of Kadoma, Japan

[73] Assignee: Matsushita Electric Works, Ltd., Osaka, Japan

[21] Appl. No.: 265,332

[22] Filed: May 19, 1981

[30] Foreign Application Priority Data

May 20, 1980 [JP] Japan ..... 55-67306

[51] Int. Cl.[3] ..... H01H 73/12

[52] U.S. Cl. ..... 335/8; 335/10

[58] Field of Search ..... 335/8, 9, 10

[56] References Cited

U.S. PATENT DOCUMENTS 3,073,927 1/1963 Hill et al. ..... 335/10

3,530,412 9/1970 Gryctko ..... 335/8

3,706,056 12/1972 Chabot ..... 335/10

*Primary Examiner*—Harold Broome

*Attorney, Agent, or Firm*—Burns, Doane, Swecker & Mathis

[57] ABSTRACT

A circuit breaker having a plurality of breaker units, in each of which a movable contact of a movable contactor is separated from and engaged with a fixed contact of a fixed contactor from the exterior of a breaker housing by a manual contact opening and closing mechanism which is made operative to close the contacts normally with a tripping link retained as locked to the mechanism and inoperative with the link released from the mechanism by a tripping means responsive to an excess current. The tripping link is operatively interconnected to those in other units through a single coupling rod to cooperate simultaneously with the releasing by the tripping means in either one of the units.

4 Claims, 16 Drawing Figures

CIRCUIT BREAKER

This invention relates generally to circuit breakers capable of breaking power supply circuit to an associated load responsive either to a short-circuit current or a continuously existing excess current beyond the rated current of the load and, more specifically, to a circuit breaker including a plurality of breaker units for use with, for example, a multi-phase A.C. power source and means for efficiently interlinking all forcibly movable-contact tripping means in the respective units so that, upon an actuation of the tripping means in one of the breaker units to open fixed and movable contacts in the unit, the contact opening can be performed in all other units without any time lag.

The circuit breaker of the kind referred to generally comprises a plurality of breaker units corresponding in number to poles of, for example, three-phase alternating current source, and the breaker units comprise respectively a fixed contactor having a fixed contact, a movable contactor having a movable contact which is normally engageable with the fixed contact responsive to operations of a manual contact opening and closing mechanism, an arc suppressing means disposed in the vicinity of opening and closing positions of the movable contact with respect to the fixed contact, and a tripping means operably coupled to the movable contactor for forcibly separating the same from the fixed contactor in response to the short-circuiting or excess current. Normally, the contacts in all of the units are opened by separating the movable contactors from the fixed contactors with an actuation of the manual contact opening and closing mechanism. On the other hand, when a short-circuit occurs or an excess current beyond the rated current of the load current continuously flows through the circuit, the respective tripping means in all of the units are caused to simultaneously operate so as to separate the movable contactors from the fixed contactors and open the all contacts in the same manner as the manual contact opening operation. The arc generated upon the opening of the contacts is driven toward the arc suppressing means of each breaker unit to be thereby divided, cooled and suppressed.

The forcibly tripping means in the respective breaker units has been arranged, practically, to be provided with a tripping metal fitting connected to an associated interlinkage plate which in turn is secured through a supporting member to a base forming a part of the housing to have the respective interlinkage plates in all of the breaker units operated as interlinked with each other. According to this arrangement, however, the number of component parts has been made large and their assembling work has been rather complicate.

A primary object of the present invention is, therefore, to provide a circuit breaker wherein an interlinkage tripping means provided in common to the respective breaker units has a simpler arrangement, whereby the number of components can be reduced and the assembling workability can be remarkably improved.

Another object of the present invention is to provide a circuit breaker wherein a test tripping means is mounted to the interlinkage tripping means of a simpler arrangement so as to allow the arrangement of the test tripping means itself to be simpler.

A further object of the present invention is to provide a circuit breaker wherein a proper slight elasticity is provided to the interlinkage tripping means so that any positional deviation due to dimensional error in the component parts can be effectively absorbed.

Other objects and advantages of the present invention shall become clear as the following descriptions of the invention advance with reference to preferred embodiments of the invention shown in accompanying drawings, in which.

Figure 1:
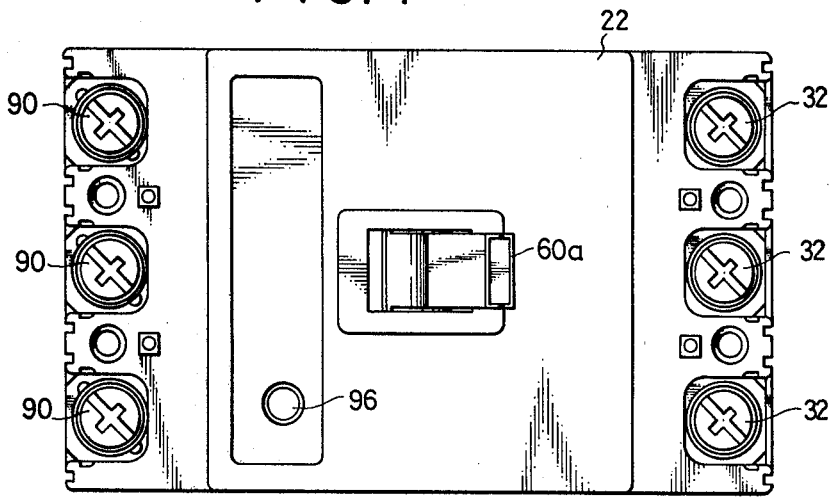
FIG. 1 is a plan view of a circuit breaker for use with three-phase A.C. power source in accordance with an embodiment of the present invention.
Figure 2:
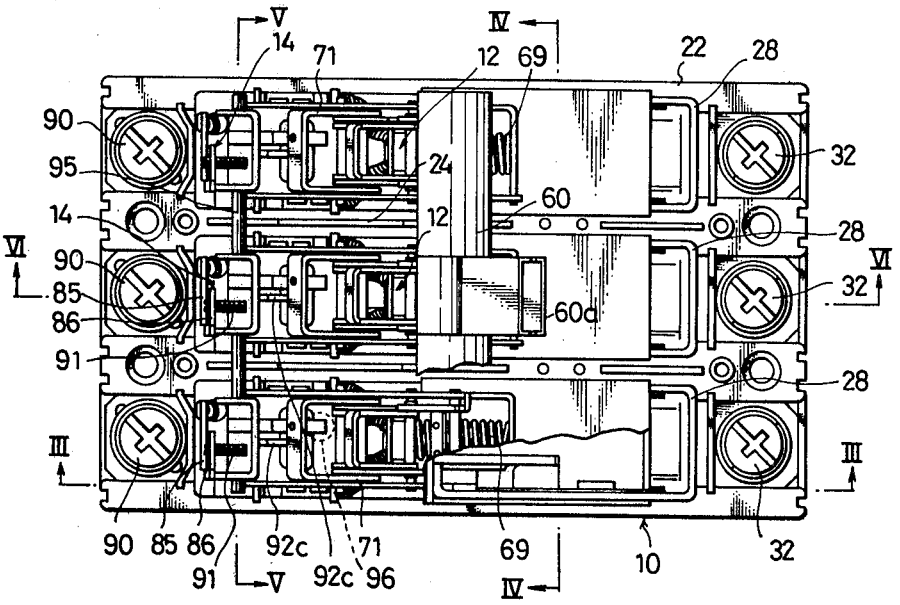
FIG. 2 is a plan view of the circuit breaker of FIG. 1, with the cover member removed and certain parts cut away for showing the interior thereof.

While the present invention shall now be referred to with reference to the preferred embodiments shown in the drawings, it should be understood that the intention is not to limit the invention only to those embodiments but to rather include all other possible modifications, alterations and equivalent arrangements within the scope of appended claims.

Referring now to the drawings, there is shown a circuit breaker according to an embodiment of the present invention which comprises generally a contact section 11 disposed substantially in the center of a housing 10, a manual contact opening and closing mechanism 12 which can open and close the contact section from the exterior of the housing 10, an electromagnetic tripping means 13 responsive to a short-circuit current to open the contact section, a heat sensitive tripping means 14 responsive to an excess current beyond the rated current to also open the contact section, and arc suppressing means 15 which electromagnetically attracts, divides, cools and suppresses the arc generated at the time of opening the contacts in the contact section.

More specifically, the housing 10 comprises a hollow base 21 and hollow cover member 22 with which the base 21 is covered on its open side. The housing 10 defines therein a plurality of unit receiving chambers 25, which are three in the present instance for respectively receiving each of three breaker units for the three-phase source current, by means of partition walls 23 provided as erected and partitioning plates 24 which are inserted respectively in a groove made in each partition wall 23. Substantially in the center of each unit receiving chamber 25, a substantially T-shaped fixed contactor 26 which forming a part of the contact section 11 in each breaker unit is disposed. A fixed contact 27 is rigidly secured to the lower portion of the fixed contactor 26 which is secured with screws onto a free end of a linkage frame 28 of U-shape configuration as viewed from the top. This linkage frame 28 is seated in turn on a shoulder 29 formed on the base 21. To the base portion of the linkage frame 28, a power source side terminal 30 is connected as welded, and the terminal 30 is mounted on a base portion 31 extending from one end of the unit receiving chamber 25 of the power source side terminal 30 which is firmly secured to the base 21 by means of a terminal screw 32 and nut 33.

On the other hand, a first arc running plate 34 is provided to extend integrally from the lower end portion of the fixed contactor 26, and this arc running plate 34 comprises a lower portion **35*a* extending horizontally toward the base portion of the linkage frame 28, an intermediate portion 35*b* extending diagonally upward so as to describe an arc toward the base portion of the linkage frame and an upper portion 35*c* extending horizontally over the linkage frame 28 in a slightly spaced relation to the frame. Further, a second arc running plate 36 is provided as secured onto the bottom surface of the base 21 beneath the contact section so as to extend from a position beneath the contact section 11 to a position beneath the upper portion 35*c* of the first arc running plate 34. Therefore, the first and second arc running plates 34 and 36 mutually define a first parallelly opposing part with a relatively smaller space and a second parallelly opposing part with a relatively larger space, with a deion grid assembly 37 is arranged within the larger space between the second opposing parts of these running plates. The assembly 37 comprises a plurality of grids 38 arranged parallel to one another as held between a pair of insulative side plates 39 and 39*a*, and the intermediate portion 35 of the first arc running plate 34 is partly positioned within aligned arcuate notches of the respective grids 38**.

The deion grid assembly 37 is provided on the side of the power source side terminal with a back plate 40 having many holes for discharging the arc gas therethrough and, between the back plate 40 and the base portion 31 carrying the power source side terminal 30, a screen 41 provided at its surface with an N-shaped protrusion 42 is interposed so as to engage with one surface of the back plate 40 of the grid assembly. The screen 41 is also provided with a gas discharging window 43 which opens downward and is cut into a triangle shape, so that the arc gas will flow upward through the holes in the back plate 40 and the gas discharging window 43 which occupies a relatively small area on the screen 41, along the inner walls of the base 21, and further to the exterior through gas discharging holes made in a small V-shaped discharge plate 44 secured to the inner surface of the cover member 22. In addition, the deion grid assembly 37 of the arc suppressing means 15 is surrounded by a front insulative plate 45 disposed on a side surface of the fixed contactor 26 in the contact section 11, insulative side plates 46 and **46*a* arranged between the both side walls of the linkage frame 28 and a top plate 47 opposed closely and over the top surface of the first arc running plate 34, so as to provide a proper isolation of the arc suppressing means 15 from the exterior. Furthermore, the arc suppressing means 15 includes a pair of supporting plates 48 and 48*a* disposed on the both sides of the first arc running plate 34 and respectively having an arcuate side edge of the same curvature as the intermediate portion 35*b* of the first arc running plate 34, and these plates 48 and 48*a* extend partially into gaps between the notches of the deion grid assembly 37. Between the supporting plates 48 and 48*a*, a pressing plate 49 having a lower surface made to be engageable with the lower portion 35*a* and intermediate portion 35*b* of the first arc running plate 34 is disposed so that the arc running plate 34 will be prevented from being caused to float by the arc gas. On the other hand, an end plate 50 is provided at an end on the side of the power source side terminal of the unit receiving chamber 25 so as to close a gap formed between the gas discharge plate 44 and the power source side terminal 30. A screen plate 51 is provided to the bottom surface of the base portion 31 of the terminal 30** so as to avoid any unfavorable influence on the terminal by the gas flowing therearound.

The contact section 11 disposed substantially in the center of the unit receiving chamber 25 includes a movable contactor 52 forming the other member of the section and having a movable contact 53 which contacts with and separates from the fixed contact 27 of the fixed contactor 26. Further, the movable contactor 52 is secured to a contactor frame 54 of a magnetic material, at least a part of which has the same length as the movable contactor, and they are joined by means of couplings of their extrusions into complementary holes and their lugs onto receiving notches. The frame 54 is U-shaped as viewed from the top and opened on the side of receiving the movable contactor 52, and the frame 54 is provided with a pivot shaft 55 passed through the frame substantially in the middle thereof and with arcuate ends 56 and **56*a* respectively including an arcuate hole and formed at both top ends, for being coupled to the manual contact opening and closing mechanism 12. Thus, first link arms 57 and 57*a* of the mechanism 12 are coupled at their one end to respective ends of the pivot shaft 55 from both sides of the frame 54 and at the other end through another pivot shaft 58 to one end of both side leg parts of an H-shaped second link arm 59, while the other ends of the both leg parts of the second link arm 59 are coupled through a supporting shaft 62 to one end of a handle link 61 which fits in a handle 60. An arm portion 60*a* is formed on the handle 60 so as to extend out of the cover member 3**.

Further, the other end of the handle link 61 fitted to the handle 60 is pivoted through a pivot shaft 65 to lug portions 64 and **64*a* of a pair of supporting frames 63 and 63*a* which hold the manual contact opening and closing mechanism 12 on its both sides. The supporting frames 63 and 63*a* are provided with windows 66 and 66*a* which are respectively aligned horizontally with each other, and the pivot shaft 58 for the first and second link arms is loosely fitted in these windows 66 and 66*a* so that diagonal downward displacement of the first and second link arms will be normally restricted by projections 67 and 67*a* made in the windows 66 and 66*a***.

The supporting frames 63 and 63*a* bear both ends of a shaft 67 passed freely shiftably through the arcuate holes in the arcuate ends 56 and 56*a* of the contactor frame 54 and a strong compression spring 69 is loaded between the upper portion of the movable contactor 52 and an end face of the supporting frame. In addition, a reversing spring 70 is hung between the pivot shaft 58 and the shiftable shaft 68, while the shaft 58 is freely shiftably inserted in arcuate slots made in a latch link 71, and base end of this latch link 71 is pivoted through a supporting shaft 72 between the supporting frames 63 and 63*a*.

One of the supporting frames which is 63*a* in the present case has a horizontal mounting yoke portion 67*a*' to which a pair of yoke plates 73 and 73*a* are mounted to form as joined a U-shaped configuration forming a part of the electromagnetic tripping means 13. Between the yoke plates 73 and 73*a* is arranged a plunger unit 75 which in turn is inserted in a coil 74. An insulative cylinder 76 of the plunger unit 75 secures at an end surface of the cylinder a stationary iron core 77 which is fitted into a hole formed in one of the yoke plates 73, while the cylinder 76 is fitted at a small diameter portion in a hole made in the other yoke plate 73*a*. The cylinder 76 contains a plunger 78 for reciprocating motion therein and a driving rod 79 is rigidly secured to the plunger, and a free end of the driving rod 79 is engaged in a slot made in the movable contactor frame 54. Further, an operating rod 80 is reciprocally held as passed through the stationary iron core 77 so as to be extended out of the cylinder 76 by a motion of the plunger 78 against the action of a return spring 81 disposed within the cylinder. Further, an end of the coil 74 is joined to an intermediate terminal 82 which is fastened by means of a screw to an end portion on the side of the contact section 11 of the second arc running plate 36. A woven wire conductor 83 is connected at one end to the intermediate terminal 82 at the other end to the movable contactor 52. The other end of the coil 74 is connected to another intermediate terminal 84.

The other end of the intermediate terminal 84 is connected to the bottom portions of a heater plate 85 and bimetal 86 both of which form the heat-sensitive tripping means 14. A woven wire cable 87 connects the heater plate 85 to a load side terminal 89 which is fastened onto a base portion 88 of the other end of the unit receiving chamber 25 by means of a terminal screw 90. When the heater plate 85 is heated with such arrangement as above, the bimetal 86 is caused to bend on the side of the manual contact opening and closing mechanism 12. To a tip portion of the bimetal 86 is screwed an adjustable pushing piece 91.

Figure 3:
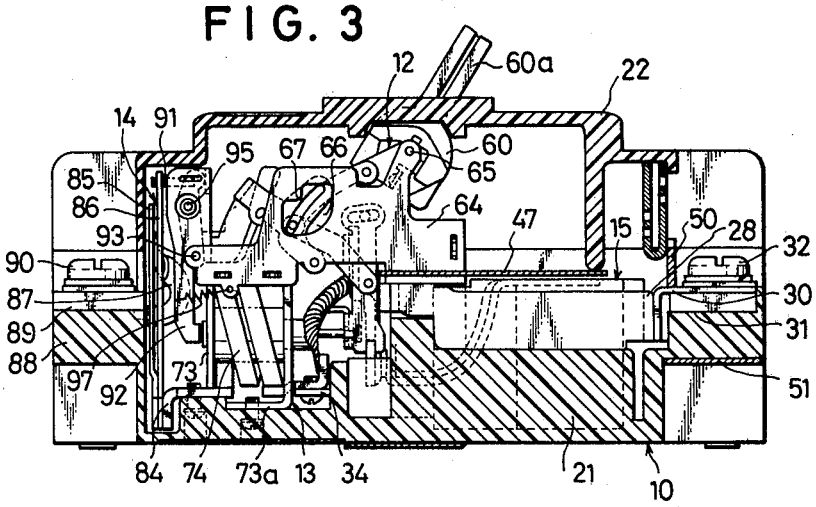
FIG. 3 is a cross-sectional view of the breaker taken along line III—III in FIG. 2.
Figure 4:
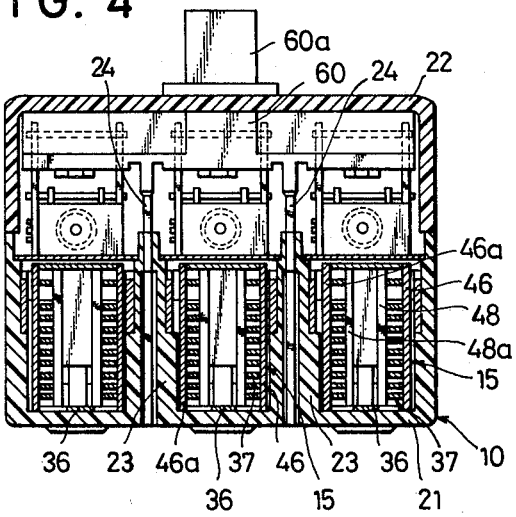
FIG. 4 is a cross-sectional view of the breaker taken along line IV—IV in FIG. 2.
Figure 5:
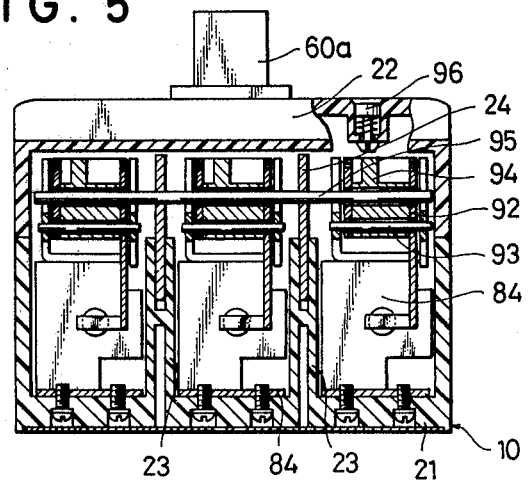
FIG. 5 is a cross-sectional view of the breaker taken along line V—V in FIG. 2.

A tripping link 92 is pivotably connected at its middle portion to the other ends of the supporting frames 63 and 63*c* on the side of the load side terminal with a pivot shaft 93, and this tripping link 92 is provided with a lower driven portion 92*a* which is engageable with the operating rod 80 of the plunger unit 75 and with an upper driven portion 92*b* which is engageable with the pushing piece 91 of the bimetal 86. The tripping link 92 is made in a U-shape as viewed from the top so that a test-tripping piece 94 can be pivoted at its lower end between both legs of the U-shape by means of a pivot shaft 93. The tripping link 92 has also an extruded portion 92*c* which engages with a bridge portion 71*a* of the latch link 71. The tripping link 92 and test tripping piece 94 in each circuit breaker unit are interconnected to each other by a single coupling rod 95 (FIG. 3) penetrating through them. The rod 95 comprises an iron core and a plastic tube covering the core so as to be provided with a resiliency for absorbing any positional error between the tripping link 92 and test tripping piece 94 in each breaker unit. The test tripping piece 94 itself has a pressing portion 94*a* which normally engages with the upper driven portion 92*b* of the tripping link 92 and a driven arm portion 94*b* which is projected in the same direction as the engaging portion 92*c* and subjected to an external force given through a test push-button 96 mounted on the cover member. A return spring 97 is hung between the tripping link 92 and the supporting frame 63 to provide a return force to the tripping link 92.

Figure 6:
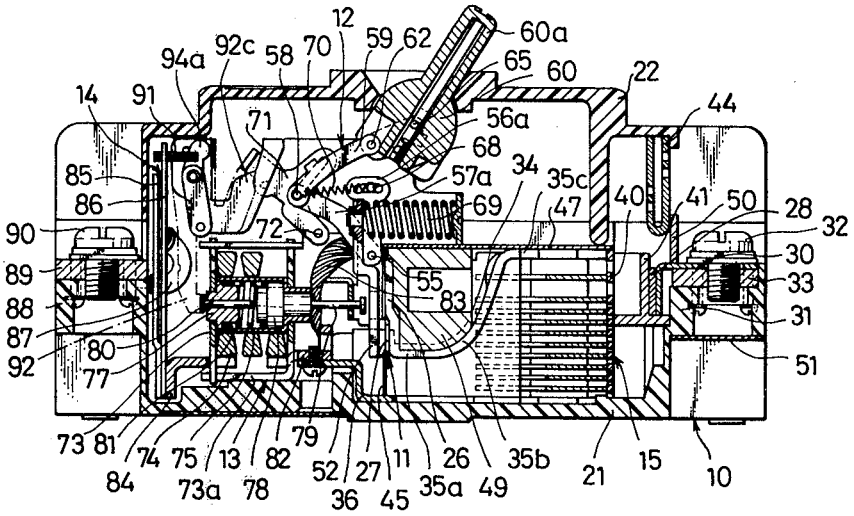
FIG. 6 is a cross-sectional view of the breaker taken along line VI—VI in FIG. 2, but showing a state where the contacts are in the closed position.

Now, the general operation of the circuit breaker according to the present invention shall be briefly explained. FIG. 6 shows a state in which the handle 60 is in a position rotated clockwise in the drawing, upon which rotation the pivot shaft 58 of the first and second link arms 57, 57*a* and 59 will move downward along the arcuate slots in the latch link 71 in such manner that the contactor frame 54 and movable contactor 52 will move toward the fixed contactor 26 to thereby engage the movable contact 53 with the fixed contact 27 to form achieve their closed position.

Figure 7:
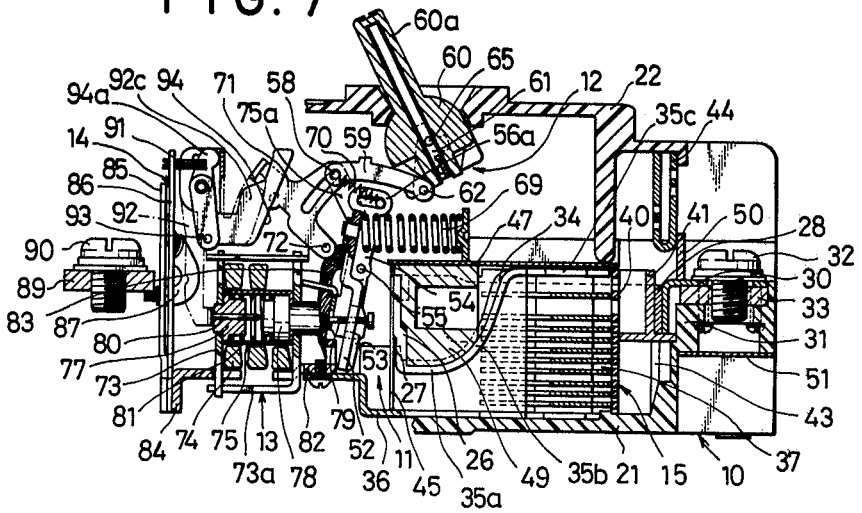
FIG. 7 is a cross-sectional view of the breaker taken along line VI—VI in FIG. 2 and similar to FIG. 6 but showing a state where the contacts are in the open position.

On the other hand, a counterclockwise rotation of the handle 60 from a position of FIG. 6 will cause the pivot shaft 58 of the first and second link arms 57, 57*a* and 59 to move upward along the arcuate slot of the latch link 71 and thereby the contactor frame 54 and movable contactor 52 are drawn reversely to open the contacts (FIG. 7).

Figure 8:
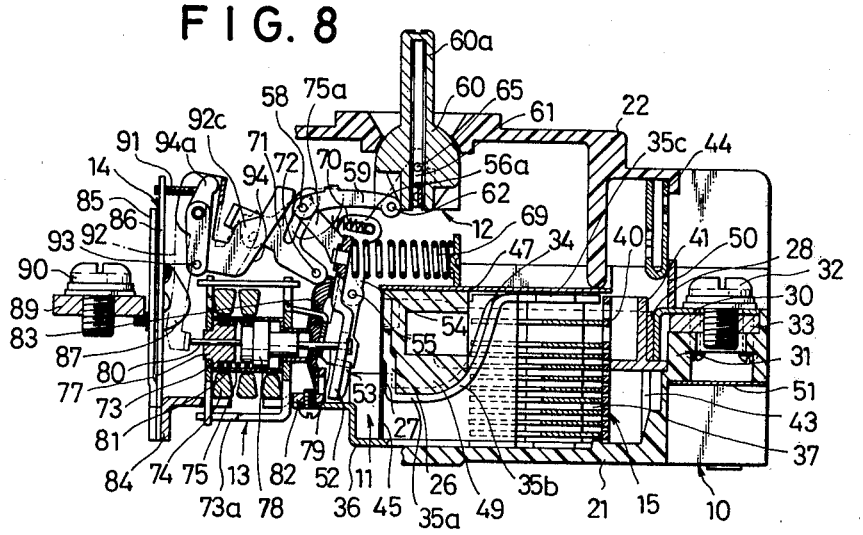
FIG. 8 is a cross-sectional view of the breaker which is also similar to FIG. 6 but showing a state where an electromagnetic tripping means is actuated to be in its tripped state.
Figure 9:
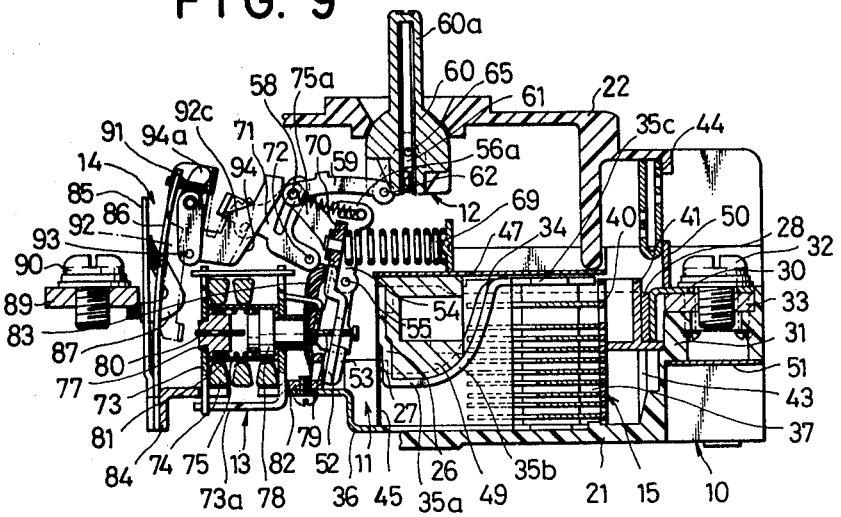
FIG. 9 is a cross-sectional view of the breaker also similar to FIG. 6 but showing a state where a heat-sensitive tripping means is actuated to be in its tripped state.
Figure 10:
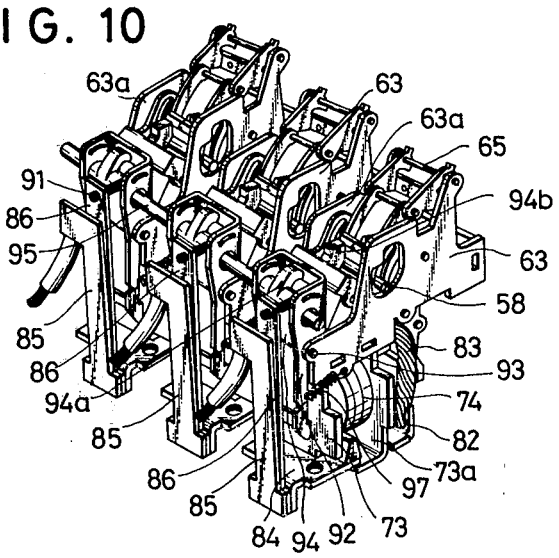
FIG. 10 is a perspective view of the breaker in FIG. 1, with the housing removed.
Figure 11:
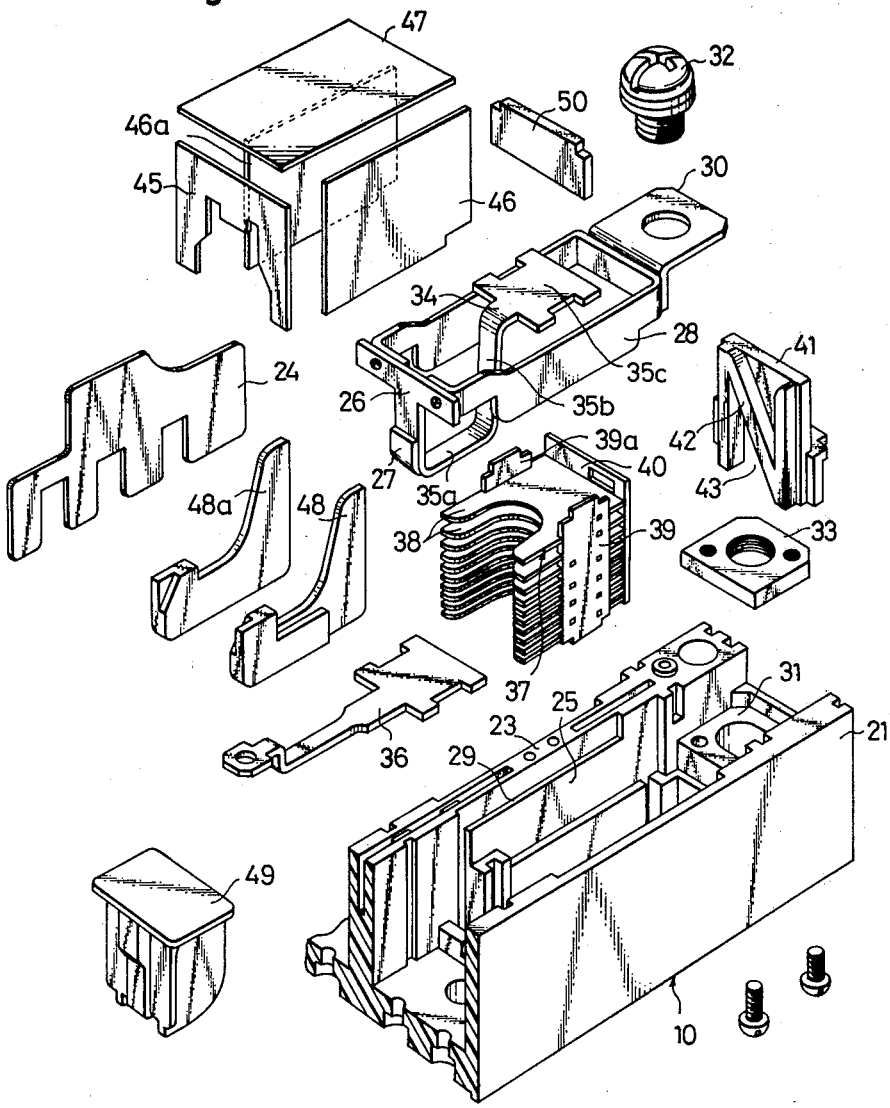
FIG. 11 is a perspective view of an arc suppressing means used in the breaker of FIG. 1, with all parts disassembled.
Figure 12:
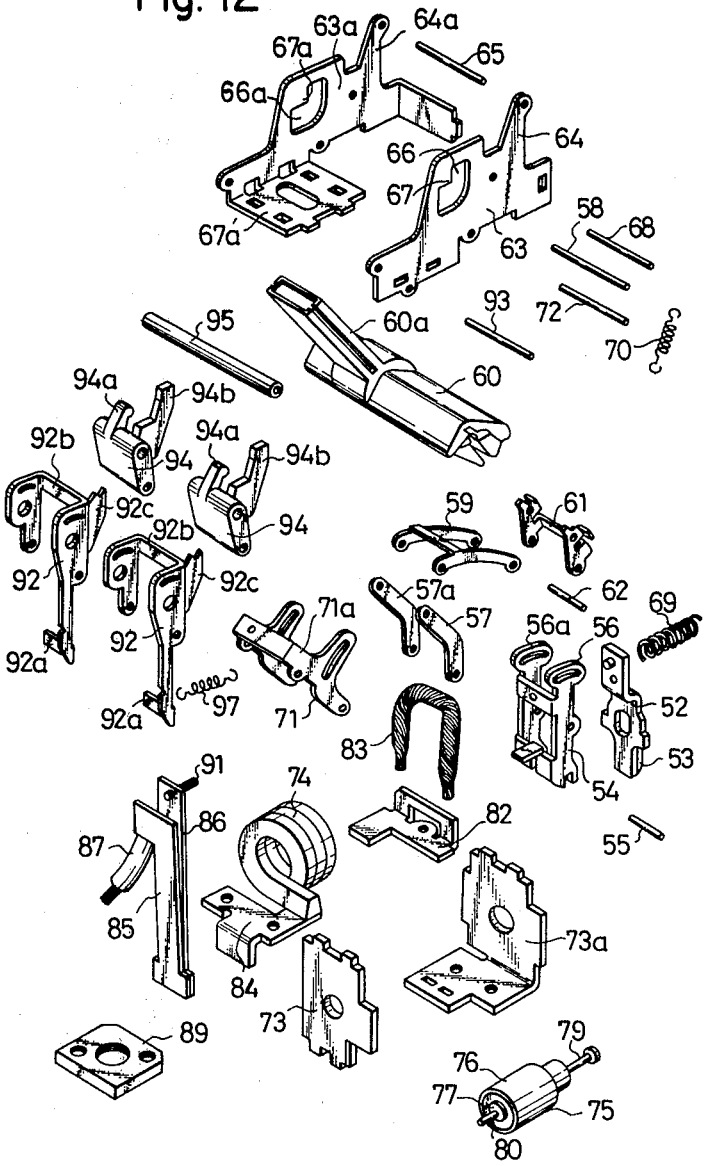
FIG. 12 is a perspective view as disassembled of most component parts forming the contact section, manual contact opening and closing mechanism and forcibly tripping means which includes an interlinkage tripping member according to the present invention, used in the breaker of FIG. 1.
Figure 13A:
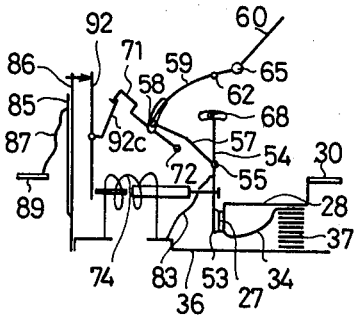
FIGS. 13A to 13D are explanatory views for schematically showing the respective state of FIGS. 6 to 9.
Figure 13B:
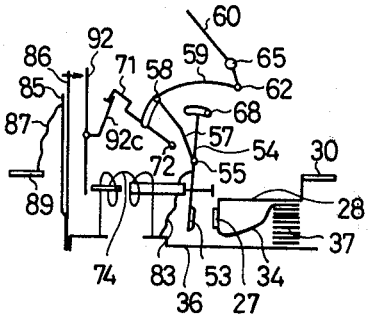
Figure 13C:
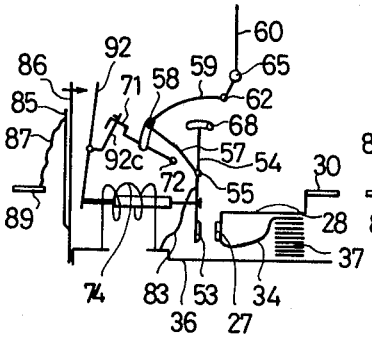
Figure 13D:
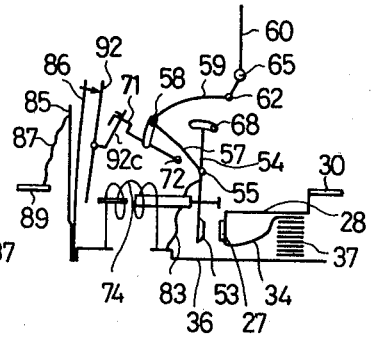

If a short-circuit current flows through a conduction circuit of the power source side terminal 30, linkage frame 28, fixed contactor 26, fixed contact 27, movable contact 53, movable contactor 52, conductor 83, intermediate terminal 82, coil 74, intermediate terminal 84, bimetal 86, heater plate 85, conductor 87 and load side terminal 89, then magnetic excitation induced in the coil 74 by the current will attract the plunger 78 onto the stationary iron core 77 of the plunger unit 75, whereby the operating rod 80 is caused to extend out of the plunger unit 75 to push the lower driven portion 92*a* of the tripping link 92 toward the load terminal side. This will allow the upper portion of the tripping link 92 to rotate clockwise about the pivot shaft 93 so that the engagement portion 92*c* will be disengaged from the latch link 71 which is coupled to the pivot shaft 58 of the first and second link arms 57, 57*a* and 59, whereby the manual contact opening and closing mechanism 12 is turned into a tripped state wherein the compression spring 69 urges the movable contactor 52 to be separated from the fixed contactor 26 to quickly open the contacts (FIG. 8).

Further, when an excess current over the rated current continues to flow through the conduction circuit between the load side terminal 89 and the power source side terminal 30, the heater plate 85 is thereby caused to generate heat and the bimetal 86 is eventually caused to bend toward the manual contact opening and closing mechanism 12. The thus bent bimetal 86 urges, through the pushing piece 91, the upper driven portion 92*b* of the tripping link 92 to rotate clockwise, resulting in a quick opening of the contacts, as in the case of the foregoing short-circuit current..

In performing the test tripping of the contacts after the circuit breaker is assembled, the operator manually presses the test push-button from the exterior of the cover member 22 to push the driven arm portion 94*b* of the test tripping piece 94, the latter of which will then pivot about the pivot shaft 93 to cause the upper driven portion 92*b* to be rotated clockwise by the pressing portion 94*a*, whereby the same contact opening as in the case of the foregoing excess current can be performed.

According to one of the remarkable features of the present invention, as will be apparent from the above disclosures, all of the tripping links which respectively cooperate with the manual contact opening and closing mechanism in the respective breaker units corresponding in number to the poles of multi-phase A.C. power source can be actuated simultaneously by the single interlinkage rod. In other words, the interlinkage motion of the tripping links can be effected by means of the interlinkage rod 95 (FIG. 3) passed horizontally through the all tripping links in the respective breaker units. Therefore, when the electromagnetic tripping means or heat-responsive tripping means in one of the breaker units operates to rotate the associated tripping link clockwise in the drawings, the interlinkage rod is parallelly displaced within the housing substantially in the horizontal direction, or in a direction transversely of the housing, toward the manual contact opening and closing mechanism, whereby the tripping links in the other units linked to the particular tripping link are also rotated clockwise so that the tripping links in all the breaker units are disengaged from the associated latch links substantially simultaneously. The respective manual contact opening and closing mechanisms in all the breaker units are thereby turned into their tripped state, where the handle is shifted to its neutral position and the movable contactors are separated from the fixed contactors at least by means of the spring force of the respective compression springs, In this case, the horizontal or transverse movement of the interlinkage rod even by a slight amount will perform the simultaneous interlinked motion of all the tripping links in all the breaker units, so that all the contacts in the entire circuit breaker can be simultaneously opened without involving substantial time lag, thus achieving an excellent response to the excess current at a high speed. Further, a mere insertion of the single interlinkage rod through the all tripping links can provide a sufficiently favorable interlinkage function, with the minimized number of necessary component parts which resulting in the improved assembling workability.

Since the interlinkage rod is provided with an elasticity by means of the plastic material in the form of a tube, further, the rod can absorb certain extent of positional error or fluctuation between the respective breaker units, and the rod can be easily passed through the respective tripping links during the assembly.

It is preferable generally that the operational function of the tripping links can be checked from the exterior after the circuit breaker is completely assembled. According to the present invention, the test tripping member is also provided to the interlinkage rod and inserted in the tripping links so that, when the checking push-button exposed out of the housing is operated, the member will be rotated to cause the tripping links to be rotated clockwise and, in this respect, too, the arrangement of the circuit breaker having various functions can be remarkably simplified.

What is claimed is:

1. A circuit breaker comprising a housing, a handle extending out of said housing, and a plurality of breaker units housed respectively in each of compartments defined in the housing, each of said breaker units comprising a manual contact opening and closing mechanism capable of being operated from the exterior through said handle and having a link operatively connected to the handle, said manual mechanism being made operative normally with a tripping link retained as locked to the mechanism and inoperative with said tripping member released from the mechanism, a movable contactor having a movable contact and capable of being rocked by the manual mechanism, a fixed contactor having a fixed contact with and from which said movable contact is engaged and separated, a resilient means for biasing said movable contactor normally away from said fixed contactor, an arc suppressing means disposed adjacent the fixed contactor for dividing, cooling and suppressing an arc generated upon openings of the contacts, and a tripping means responsive to an excess current for forcibly releasing the tripping link from the manual mechanism so as to cause the movable contactor rocked to be separated from the fixed contactor at least due to said biasing of said resilient means, an interlinkage rod is further provided as passed through all the tripping links in all of the breaker units so that, upon released motion of one of the tripping links, all other tripping links will cooperate therewith through said rod, and a test tripping member carried on said interlinkage rod for rotating said tripping links upon an application of external force.

2. A circuit breaker as defined in claim 1 wherein said tripping link is pivoted to be rockable upon receiving an actuation of said tripping means, and said interlinkage rod is provided to be shiftable substantially in parallelly horizontal direction due to a rocking motion of one of the tripping links.

3. A circuit breaker as defined in claim 1 wherein said interlinkage rod comprises an iron core and a plastic tube having an elasticity and covering said iron core.

4. A circuit breaker comprising a housing, a handle extending out of said housing, and a plurality of breaker units housed respectively in each of compartments defined in the housing, each of said breaker units comprising a manual contact opening and closing mechanism capable of being operated from the exterior through said handle and having a link operatively connected to the handle, said manual mechanism being made operative normally with a tripping link retained as locked to the mechanism and inoperative with said tripping member released from the mechanism, a movable contactor having a movable contact and capable of being rocked by the manual mechanism, a fixed contactor having a fixed contact with and from which said movable contact is engaged and separated, a resilient means for biasing said movable contactor normally away from said fixed contactor, an arc suppressing means disposed adjacent the fixed contactor for dividing, cooling and suppressing an arc generated upon openings of the contacts, and a tripping means responsive to an excess current for forcibly releasing the tripping link from the manual mechanism so as to cause the movable contactor rocked to be separated from the fixed contactor at least due to said biasing of said resilient means, an interlinkage rod is further provided as passed through all the tripping links in all of the breaker units so that, upon released motion of one of the tripping links, all other tripping links will cooperate therewith through said rod, said tripping link being pivotably rockable upon being actuated by said tripping means, said interlinkage rod being mounted for shifting movement in a horizontal direction in response to a rocking motion of one of said tripping links, said interlinkage rod comprising an iron core and an elastic plastic tube covering said iron core, and a test tripping member carried on said interlinkage rod for rotating said tripping links upon an application of external force.

* * * * *